US009521904B2

(12) United States Patent
Moayeri

(10) Patent No.: US 9,521,904 B2
(45) Date of Patent: Dec. 20, 2016

(54) GUN SAFE CABINET

(71) Applicant: Brian Winn, Bothell, WA (US)

(72) Inventor: Ali Moayeri, Mill Creek, WA (US)

( * ) Notice: Subject to any disclaimer, the term of this patent is extended or adjusted under 35 U.S.C. 154(b) by 0 days.

(21) Appl. No.: 14/922,573

(22) Filed: Oct. 26, 2015

(65) Prior Publication Data

US 2016/0088937 A1 Mar. 31, 2016

Related U.S. Application Data

(63) Continuation of application No. 14/497,877, filed on Sep. 26, 2014, now Pat. No. 9,198,512.

(51) Int. Cl.

| | |
|---|---|
| ***A47B 49/00*** | (2006.01) |
| ***A47B 81/00*** | (2006.01) |
| ***E05G 1/00*** | (2006.01) |
| ***A47B 55/00*** | (2006.01) |

(52) U.S. Cl.

CPC ..... *A47B 81/005* (2013.01); *A47B 49/004* (2013.01); *A47B 55/00* (2013.01); *E05G 1/00* (2013.01)

(58) Field of Classification Search

CPC ..... A47B 49/00; A47B 49/004; A47B 55/00; A47B 81/005; E05G 1/02

USPC ..... 312/125, 135, 280, 285, 305, 321.5; 109/45, 48; 211/4, 64, 70, 163; 42/106

See application file for complete search history.

(56) References Cited

U.S. PATENT DOCUMENTS

| | | | | |
|---|---|---|---|---|
| 405,335 | A * | 6/1889 | Amerine | A47B 81/005 211/64 |
| 492,304 | A * | 2/1893 | Markle | A47F 3/10 206/317 |
| 2,158,623 | A * | 5/1939 | Fischbacher | A47B 81/005 206/317 |
| 2,869,729 | A * | 1/1959 | Hayden | A47B 81/005 211/64 |
| 3,861,766 | A * | 1/1975 | Corsini | A47F 3/10 312/125 |
| 3,927,923 | A | 12/1975 | Kimmel | |
| 4,099,808 | A * | 7/1978 | Oakley | A47B 81/005 109/50 |
| 4,240,684 | A * | 12/1980 | Henning | B25H 3/02 312/125 |
| 6,868,975 | B2 | 3/2005 | Sells et al. | |
| 7,559,428 | B2 | 7/2009 | Matzick | |
| 7,877,920 | B2 * | 2/2011 | Szuminski | A47B 81/005 109/51 |
| 2003/0015486 | A1 | 1/2003 | Chen | |
| 2004/0140235 | A1 * | 7/2004 | Cleveland | F41A 23/18 206/315.11 |
| 2004/0164036 | A1 * | 8/2004 | Cummins | A47B 81/005 211/64 |
| 2005/0236943 | A1 * | 10/2005 | Reo | A47B 67/04 312/285 |
| 2007/0000851 | A1 * | 1/2007 | Matzick | F41A 23/18 211/64 |

(Continued)

*Primary Examiner* — James O Hansen

(74) *Attorney, Agent, or Firm* — Lowe Graham Jones PLLC

(57) ABSTRACT

A cabinet is mounted on a spindle, which may be secured to a slide-out shelf within the gun safe for additional storage. The cabinet includes one or more doors that hingedly open to allow access to the interior of the cabinet. Upper and lower external mounting surfaces are provided to retain a rifle for storage. An optional upper pistol support and an internal safe may also be included.

12 Claims, 3 Drawing Sheets

(56) References Cited

U.S. PATENT DOCUMENTS

| | | | | |
|---|---|---|---|---|
| 2008/0229983 | A1* | 9/2008 | Pendleton | A47B 81/005 109/45 |
| 2014/0345507 | A1* | 11/2014 | Pendleton | A47B 81/005 109/48 |
| 2015/0366343 | A1* | 12/2015 | Spencer | A47B 81/005 312/270.2 |

* cited by examiner

GUN SAFE CABINET

PRIORITY CLAIM

This application is a continuation of U.S. application Ser. No. 14/497,877, filed Sep. 26, 2014, the contents of which are incorporated herein.

FIELD OF THE INVENTION

This invention generally relates to gun safes, particularly including storage cabinets for use within a gun safe.

BACKGROUND OF THE INVENTION

Currently existing gun safes are commonly available in a form in which a large floor-standing safe provides for a relatively voluminous interior space for the storage of guns. In many cases, there is ample room for a large number of rifles, pistols, and related supplies such as ammunition.

It can be difficult, however, to access items stored in the gun safe without removing many of the items or otherwise moving them out of the way. For example, in a gun safe storing numerous rifles, several of the rifles may have to be removed in order to allow access to pistols or ammunition stored behind the rifles. The inclusion of shelves within gun safes is an improvement but an incomplete solution because the shelving is commonly located in a position in which the rifles still must be moved aside or out of the safe in order to access items stored on shelves.

SUMMARY OF THE INVENTION

The present invention incorporates a cabinet within the gun safe for additional storage. In one version, the cabinet is mounted on a Lazy Susan or is otherwise positioned for rotational movement. In one version, the cabinet includes one or more doors that hingedly open to allow access to the interior of the cabinet.

In some versions of the invention, the cabinet includes upper and lower mounting surfaces to retain a rifle for storage. Thus, in one example the cabinet includes a lower platform having a number of recesses or other retention areas for receiving the butt of a rifle. An upper end of the cabinet includes a surface having a complementary number of channels to receive the barrel end of a rifle.

In some examples, the upper and lower mounting surfaces may be positioned in somewhat different locations, other than at the top and bottom of the cabinet.

In one version of the invention, the cabinet and its rotating platform is supported on a shelf mounted within a gun safe in a manner that allows the shelf to expand out of the safe and to retract back into the safe.

In a preferred example of the invention, the lower cabinet platform and upper barrel mount are divided into sections that are hingedly attached to one another and connected to the cabinet doors such that the lower platform and upper barrel mount hinge open together with the opening of the cabinet doors. In this fashion, opening the cabinet doors also moves any rifles supported on the lower cabinet platform out of the way of the interior portion of the cabinet.

In some examples of the invention, the interior of the cabinet may include any number of shelves, drawers, and interior cabinet sections. In one version, the interior of the cabinet includes a lockable safe within the cabinet.

In another version of the invention, an upper portion of the cabinet includes a pistol support positioned above the cabinet on a post. The pistol support includes several openings that are sized and arranged to receive a barrel of a pistol for storage.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
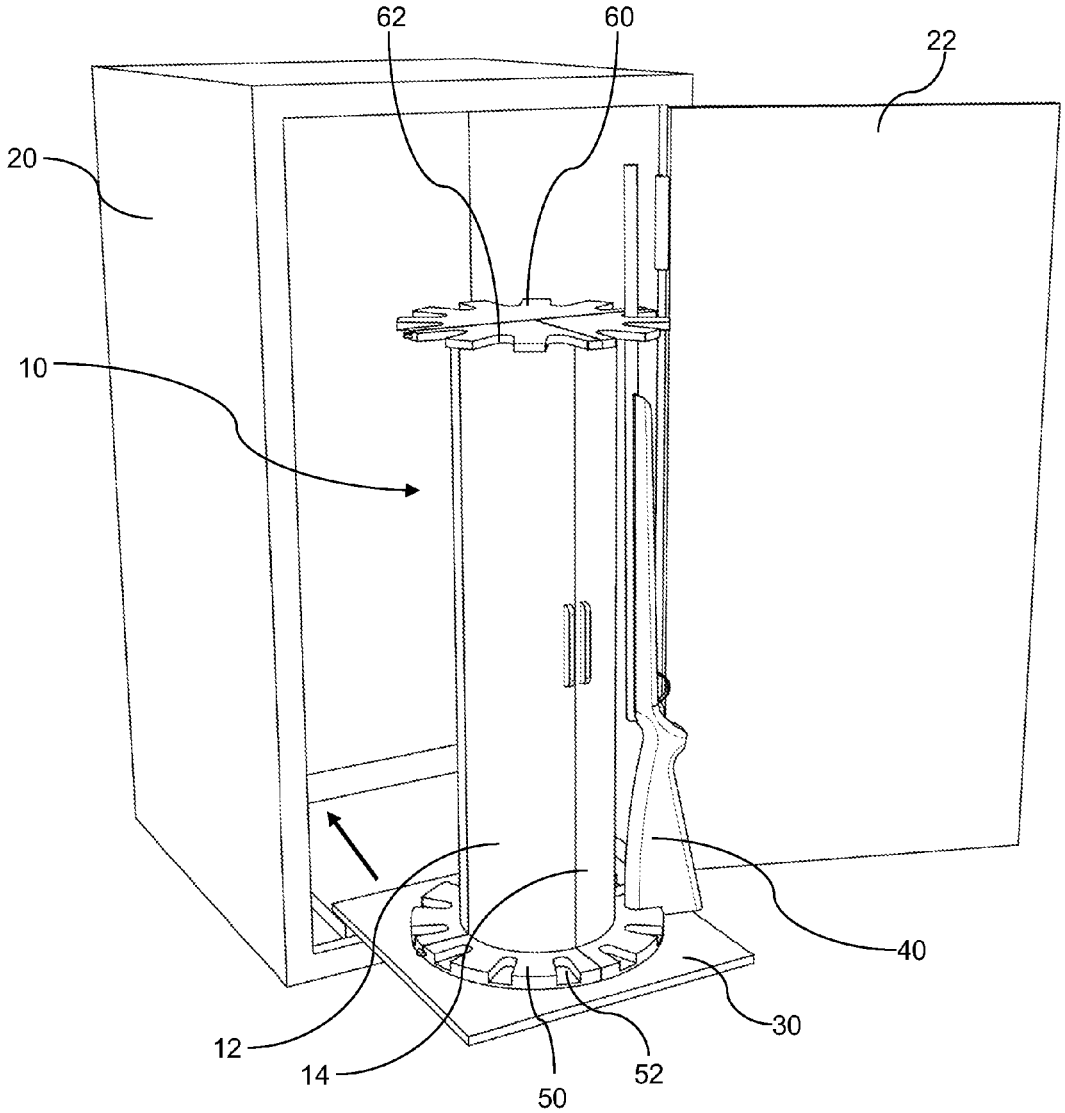
FIG. 1 is a perspective view of a preferred gun safe having an interior gun safe cabinet shown supported on an extendable shelf positioned in an extended position.

With reference to FIG. 1, a floor-standing gun safe 20 is shown with a locking door 22 illustrated in an open position. And interior gun safe cabinet 10 is positioned atop a shelf 30. The cabinet is configured with a plurality of walls defining an interior space, and one or more doors for access to the cabinet.

In the illustrated example, the shelf 30 is supported on rails or is otherwise mounted to the gun safe in a manner that allows the shelf 30 to slide inward and outward from the interior of the gun safe. In other versions, the cabinet may be mounted on a shelf that does not extend, or may be mounted to an interior floor of the safe. As shown in FIG. 1, the shelf is extended outward from the interior of the safe. As desired for storage, the shelf and cabinet can be moved into the safe, in the direction of the arrow in FIG. 1, allowing the door 22 to be closed with the cabinet locked inside.

In the preferred version as illustrated, the cabinet includes a left door 12 and a right door 14, each having a handle to allow access to the interior of the cabinet. The cabinet may have any size, but is preferably designed to have a height to accommodate a rifle stored in an upright position leaning against the cabinet as illustrated. Thus, most preferably the cabinet has a height between about three feet and about five feet from the base to the top.

The base of the cabinet is preferably configured with a bottom platform 50 which, in the illustrated example forms a substantially circular footprint when sitting on the shelf 30. The bottom platform 50 includes a number of rifle butt supports 52, which may be formed as recessed areas, cutouts, or other structures sufficient to receive and retain one end of a rifle while restricting the rifle butt against lateral or sliding movement away from the platform. In the illustrated example, twelve such bottom rifle supports are provided in the bottom platform while in other examples there may be a larger or smaller number of rifle supports.

An upper end of the cabinet includes a cabinet cap 60, which includes a complementary number of upper rifles supports 62, so that the cabinet cap 60 includes the same number of upper rifle supports as the number of lower rifle supports 52 provided in the bottom platform 50. In the version as illustrated, the cabinet cap is formed as a planar circular member in which each of the upper rifle supports is configured as an inward scalloped or other cut-out to receive a barrel of a rifle. In other versions, the upper rifle supports may be formed as outwardly extending cogs, arms, or other shapes configured to restrict the barrel of the rifle against lateral movement (that is, movement in a direction tangential to a radius extending from the center of the cabinet). As illustrated, each of the upper and lower rifle supports is configured to be open at an end extending radially away from the center of the cabinet so that the rifle 40 may be removed from the rifle supports by moving the rifle away from the cabinet in a radial direction but cannot be removed by moving the rifle only in a tangential direction.

In the illustrated version, the upper rifle supports are provided at an upper end of the cabinet, such as in the cabinet cap as shown. In other versions, an upper rifle support may be provided at a location intermediate between the bottom and the top of the cabinet rather than at the top of the cabinet. Likewise, in yet another version of the invention the cabinet may have upper, intermediate, and bottom rifle supports.

Figure 2:
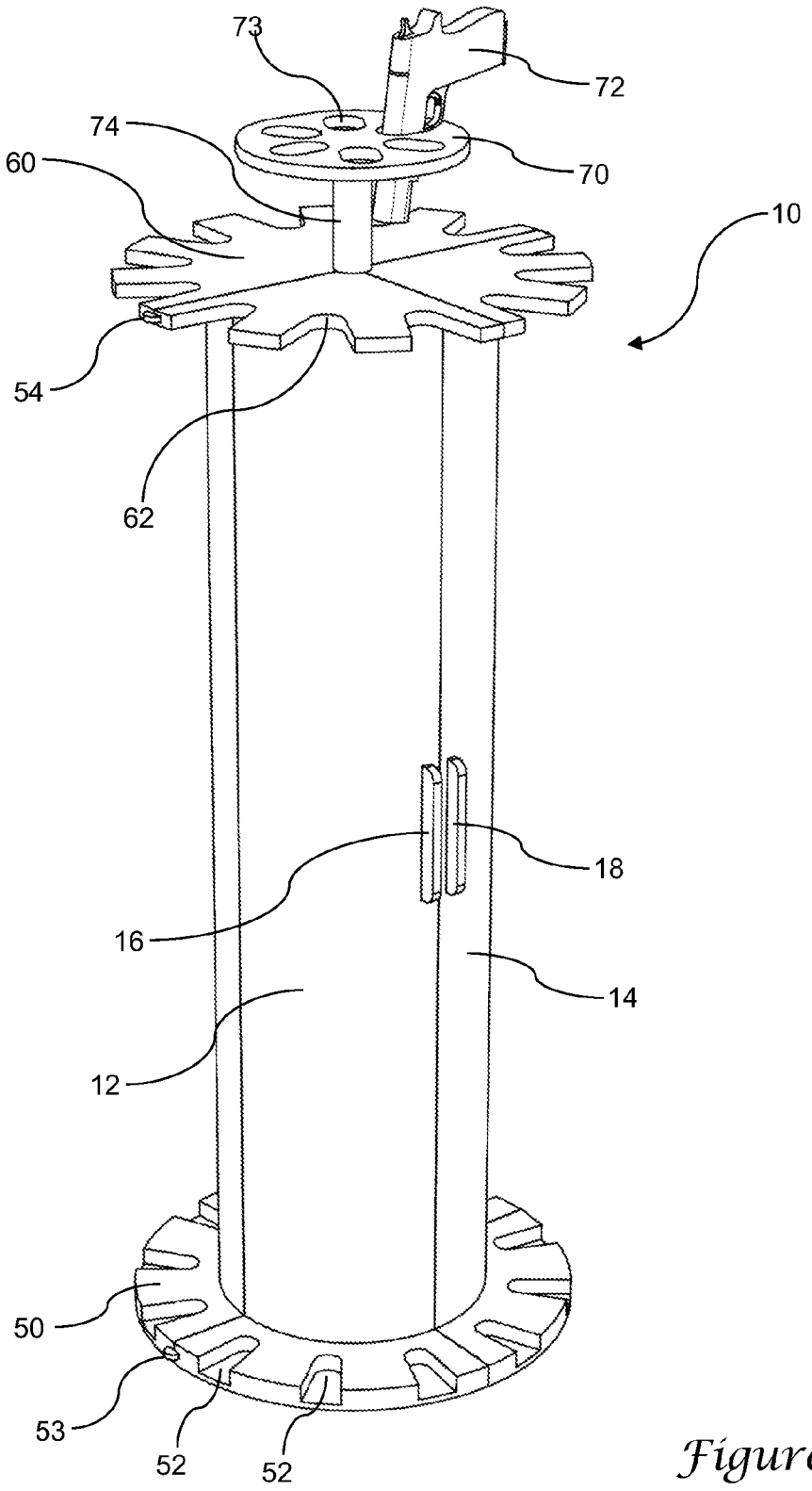
FIG. 2 is a perspective view of the gun safe cabinet of FIG. 1, shown in its position before being mounted within a gun safe cabinet, and including an upper pistol support.

With reference to FIG. 2, the cabinet 10 is shown without being mounted to a gun safe or a shelf for clarity of illustration. As with the version illustrated in FIG. 1, the cabinet 10 includes a left cabinet door 12, a right cabinet door 14, having a left handle 16 and a right handle 18. The bottom platform 50 includes a plurality of lower rifle supports 52 while the cabinet cap 60 includes a plurality of upper rifle supports 62.

The left and right cabinet doors 12, 14 are hingedly attached to a back section of the cabinet, for example at upper and lower hinges 54, 53. In the version as illustrated in FIG. 2, the upper and lower hinges 54, 53 are visible on the left side of the cabinet. Similar hinges are provided to attach the right side cabinet door, but not visible in FIG. 2.

In one preferred version, the bottom platform 50 and the cabinet cap 60 are each separated into sections and hingedly attached to one another so that the bottom platform and cabinet cap also hinge away from and toward one another as the cabinet doors are opened and closed. Thus, as illustrated in FIG. 2, upper and lower hinges 54, 53 are provided in locations to allow the bottom platform and cabinet cap 60 to hingedly open and close.

In the version as illustrated in FIG. 2, an upper pistol support 70 is also provided. In the illustrated example, a vertical post 74 extends upward from the cabinet cap 60. The vertical post supports a pistol support 70 which in one version of the invention is formed as a planar circular structure having a plurality of openings 73 sized to allow the openings to accommodate a barrel of a pistol 72 while not allowing the entire pistol to fall through the opening. The pistol support 70 need not be either planar or circular, but instead may be any of a variety of different shapes to receive and support one or more pistols. In alternate version of the invention, the pistol support 70 is configured as an upper shelf without the plurality of openings.

Figure 3:
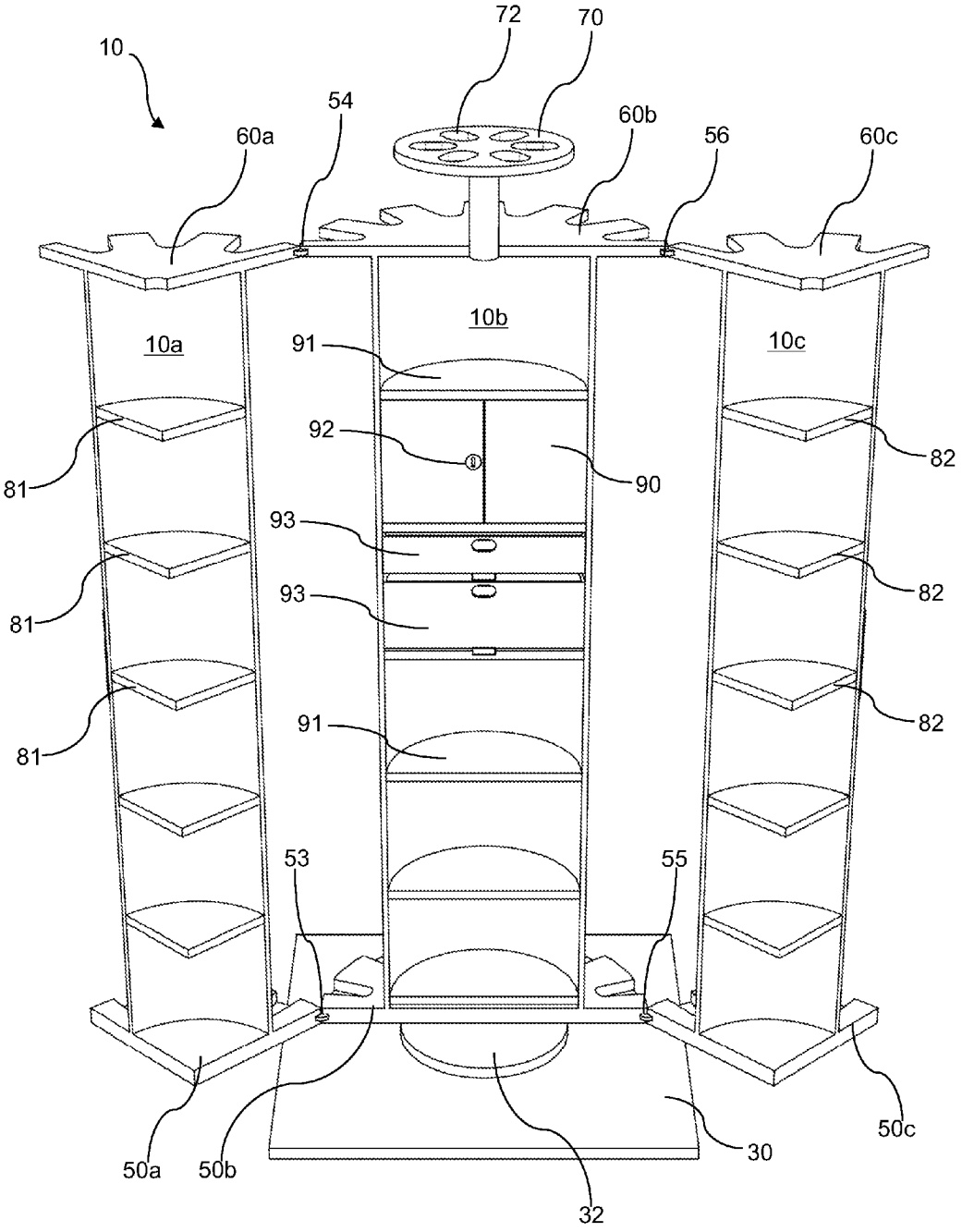
FIG. 3 is a front perspective view of the gun safe cabinet of FIG. 2, shown mounted on a support shelf and with the cabinet doors in and open position.

FIG. 3 illustrates the cabinet has shown in FIG. 2, but with the left and right doors in an open position and also shown mounted on a shelf 30. As best seen in FIG. 3, the cabinet 10 is divided into three sections, including a left section 10*a*, a rear section 10*b*, and a right section 10*c*. The rear section 10*b* is mounted on a spindle 32 which is preferably configured as a Lazy Susan spindle in which an annular support member allows a short cylindrical spindle to rotate. Because the cabinet rear section 10*b* is mounted to the spindle 32, the cabinet rear section is able to freely rotate on the spindle and therefore on the shelf 30. When the doors of the left and right cabinet sections are in the closed position, the entire cabinet can freely rotate on shelf. Likewise, the rear cabinet section is able to rotate on the spindle even when the doors are in the open position, but depending on the size of the safe and the size of the cabinet, the cabinet may or may not be able to freely rotate fully through a 360 degree turn when the doors are in the open position.

As is visible in FIG. 3, the left cabinet section 10*a* is hingedly attached to the rear cabinet section 10*b* at upper and lower hinge locations 54, 53, while the right cabinet section 10*c* is hingedly attached to the rear or main cabinet section 10*b* at another pair of upper and lower hinge locations 56, 55. Likewise, the bottom platform 50 is divided into main cabinet and door sections, which as illustrated are left, rear and right sections 50*a*, 50*b*, 50*c* that are joined at hinges 53, 55 to allow the bottom platform sections hinge open and closed. Similarly, the cabinet cap is divided into main cabinet and door sections, which as illustrated are left, rear, and right sections 60*a*, 60*b*, 60*c* that are joined at hinges 54, 56 to allow the cabinet cap sections to hinge open and closed.

Because the bottom platform and cabinet cap sections hinge open and close together with one another, the upper and lower rifle supports positioned on those hinged sections likewise hinge apart and together with one another. Thus, a rifle supported on one of the bottom support sections will remain firmly supported on that particular section even while the doors hinge open and closed to allow access to the interior of the cabinet 10.

The interior of the cabinet may include any number of features for improved storage ability within the gun safe. In one version of the invention as illustrated, the left and right cabinet sections include a plurality of left shelves 81 and right shelves 82. The rear cabinet section in the illustrated example includes a number of shelves 91, together with one or more drawers 93, and an interior safe 90 having a lock 92. These various drawers and shelves provide ample storage space for important documents, accessories, and other items that are desirable for storage within a gun safe. In addition, the internal safe 90 having its own lock 92 is especially useful for storing ammunition. In this fashion, the ammunition may be locked safely away within the cabinet so that even if a person is able to gain unauthorized access to the gun safe, the ammunition within the cabinet safe is both out of sight and cannot be readily accessed because it is stored within an interior safe contained within an interior cabinet.

In the illustrated version, the cabinet is drawn as being a generally tall vertical cylinder. In other versions of the invention, the cabinet and may be formed as a pyramid shape having a wide base and a conical top. Similarly, the top in a pyramidal shaped cabinet may have a truncated top rather than a pointed one. In yet other versions, the cabinet may be cubic rectangular in shape rather than cylindrical or pyramidal.

The illustrated version further shows a preferred version of an interior gun safe cabinet is having a symmetrical pair of hinged doors opening in a fashion that divides the cabinet into left and right sections in which each of the left right sections form one quarter of the cabinet as a whole. In some examples of the invention, only a single door may be used, rather than a pair of doors. Likewise, in the illustrated example each of the doors is configured with its own attached shelves, while in other versions of the invention the doors need not include any attached shelves or other storage features.

While the preferred embodiment of the invention has been illustrated and described, as noted above, many changes can be made without departing from the spirit and scope of the invention. Accordingly, the scope of the invention is not limited by the disclosure of the preferred embodiment.

Instead, the invention should be determined entirely by reference to the claims that follow.

The embodiments of the invention in which an exclusive property or privilege is claimed are defined as follows:

1. A storage system for a gun safe, comprising:

a cabinet defining an interior storage space and mountable within the gun safe;

at least one door movable between a closed position to enclose the cabinet and an open position to allow access to the cabinet;

a plurality of lower rifle supports positioned about an outer periphery of the cabinet;

a plurality of upper rifle supports positioned about the outer periphery of the cabinet and positioned above the plurality of lower rifle supports;

a pistol support platform positioned at the upper end of the cabinet, outside the interior storage space defined by the cabinet, the pistol platform having a plurality of pistol-receiving slots; and a spindle supporting the cabinet for rotational movement of the cabinet on the spindle, the spindle being mounted to an interior surface within the gun safe.

2. The storage system of claim 1, wherein the pistol support platform is supported by a post.

3. The storage system of claim 2, further comprising a cabinet cap, the plurality of upper rifle supports being defined on the cabinet cap, and further wherein the post extends above the cabinet cap.

4. The storage system of claim 3, further comprising a bottom support platform surrounding the lower outer periphery of the cabinet, the plurality of lower rifle supports being defined on the bottom support platform.

5. The storage system of claim 4, further comprising a plurality of shelves housed within the cabinet.

6. The storage system of claim 4, wherein the spindle is mounted on a shelf, the shelf being configured for lateral movement into and out of the gun safe.

7. The storage system of claim 6, wherein the shelf is attached to a lower interior portion of the gun safe.

8. A storage system for a gun safe, comprising:

a cabinet defining an interior storage space;

the cabinet further having a left door and a right door, the left door and right door each being movable between a closed position to enclose the cabinet and an open position to allow access to the interior storage space of the cabinet;

a plurality of lower rifle supports positioned about a lower periphery of the cabinet;

a plurality of upper rifle supports positioned about an upper periphery of the cabinet and positioned above the plurality of lower rifle supports;

a pistol platform supported by the cabinet above an upper exterior surface of the cabinet, the pistol platform having a plurality of slots for receiving the barrel of a pistol; and a spindle supporting the cabinet for rotational movement of the cabinet on the spindle, the spindle being mounted to an interior surface within the gun safe.

9. The storage system of claim 8, wherein the interior surface comprises a shelf, the shelf being configured for lateral movement into and out of the gun safe.

10. The storage system of claim 8, wherein each of the left door and the right door are hingedly attached to the cabinet.

11. The storage system of claim 8, wherein the cabinet is formed as an upright cylinder.

12. The storage system of claim 11, wherein the left door and the right door are each formed as a portion of an external sidewall of the upright cylinder.

* * * * *